United States Patent [19]

Angle et al.

[11] Patent Number: 4,544,192

[45] Date of Patent: Oct. 1, 1985

[54] ADJUSTABLE LATCH STRIKER

[75] Inventors: Christopher P. Angle, Laingsburg; Barry R. Parker, Lansing, both of Mich.

[73] Assignee: General Motors Corporation, Detroit, Mich.

[21] Appl. No.: 424,466

[22] Filed: Sep. 27, 1982

[51] Int. Cl.[4] ..... E05B 15/02

[52] U.S. Cl. ..... 292/341.18

[58] Field of Search ..... 292/341.18, 341.19, 292/340, DIG. 60, DIG. 38

[56] References Cited

U.S. PATENT DOCUMENTS

| | | | |
|---|---|---|---|
| 1,390,519 | 9/1921 | Evans | 292/341.18 |
| 2,798,754 | 7/1957 | Russell | 292/314.18 |
| 3,045,465 | 7/1962 | Larson | 292/341.18 X |
| 4,087,123 | 5/1978 | Redshaw | 292/341.19 |
| 4,158,463 | 6/1979 | Henrichs | 292/341.18 |
| 4,432,575 | 2/1984 | Garvey et al. | 292/341.18 |
| 4,451,071 | 5/1984 | Striese et al. | 292/341.18 |

*Primary Examiner*—Gary L. Smith
*Assistant Examiner*—Russell W. Illich
*Attorney, Agent, or Firm*—Patrick M. Griffin

[57] ABSTRACT

An adjustable striker assembly includes a mounting member on a door frame and a track member mounted thereto for sliding movement in a direction parallel to the door hinge. Cooperating resilient toothed fingers and teeth on the mounting member and track member releasably maintain them in any adjusted position. A body member, slidable relative to the track member and mounting member, includes a striker element engageable by a door latch. During door closing, the latch-striker engagement ratchets the body member and track member relative to the mounting member to automatically correct any misalignment. An adjusting screw between the mounting member and body member is adjustable to adjust the body member and striker element relative to the track member.

3 Claims, 10 Drawing Figures

ADJUSTABLE LATCH STRIKER

This invention relates to an adjustable door latch striker and especially to a striker adapted to be mounted to the jamb of a door and automatically adjustable relative to a door mounted latch upon the closing of the door.

BACKGROUND OF THE INVENTION

It is known in the art to provide elongated mounting holes on a jamb mounted striker to allow it to be adjusted and aligned relative to a door mounted latch. The striker is first loosely mounted by the elongated holes and roughly aligned with the door latch. The door is then closed partially to check the alignment, the striker is realigned and tested again in a series of successive approximations before finally secured. It is necessary to adjust the striker assembly in both a fore and aft direction relative to the vehicle and hinge axis of the door and in a direction normal to the fore and aft direction or transverse of the vehicle to obtain alignment of the striker and latch.

It is known to obtain the fore and aft adjustment of the striker through the use of a manually rotatable threaded member interposed between a mounting member mounted to the door jamb and a member supporting the striker. This is the subject of a pending application Ser. No. 334,786, now U.S. Pat. No. 4,451,071 John E. Iafret et al, filed Dec. 28, 1981, and assigned to the assignee of the present application and to TRW, Inc.

SUMMARY OF THE INVENTION

The striker of the present invention includes such fore and aft adjustment and also automatic adjustment in a direction normal to the fore and aft adjustment, thus providing complete adjustability and alignability.

The embodiment disclosed is for use with a glove box door movable about a hinge axis relative to a door jamb. The striker includes a mounting member fixed directly to the door jamb; a body member which includes a striker element adapted to be engaged by the door mounted latch on closure of the door to retain the door in closed position; and an intermediate track member which mounts the body member and is mounted to the mounting member. The track member is automatically adjustable relative to the mounting member and the body member is manually adjustable relative to the track member.

The striker and door latch include interacting camming surfaces which matingly engage as the door is closed to shift the body member and track member as a unit relative to the mounting member to thereby align the striker with the latch in a direction normal to the fore and aft direction.

It is, therefore, an object of the invention to provide a striker element which is automatically adjustable with respect to a door latch after the striker element has been mounted to the door jamb.

It is another object of the invention to provide such an adjustable striker element in which the striker is automatically alignable with the latch upon closing of the door. It is a further object of the invention to provide such an adjustable and alignable striker in which no further tightening or adjusting of the striker is necessary after its alignment. It is a still further object of the invention to provide such a striker which will automatically realign itself if misaligned after attachment.

These and other objects of the invention will become apparent from the following written description and drawings in which.

DESCRIPTION OF THE PREFERRED EMBODIMENT

Figure 1:
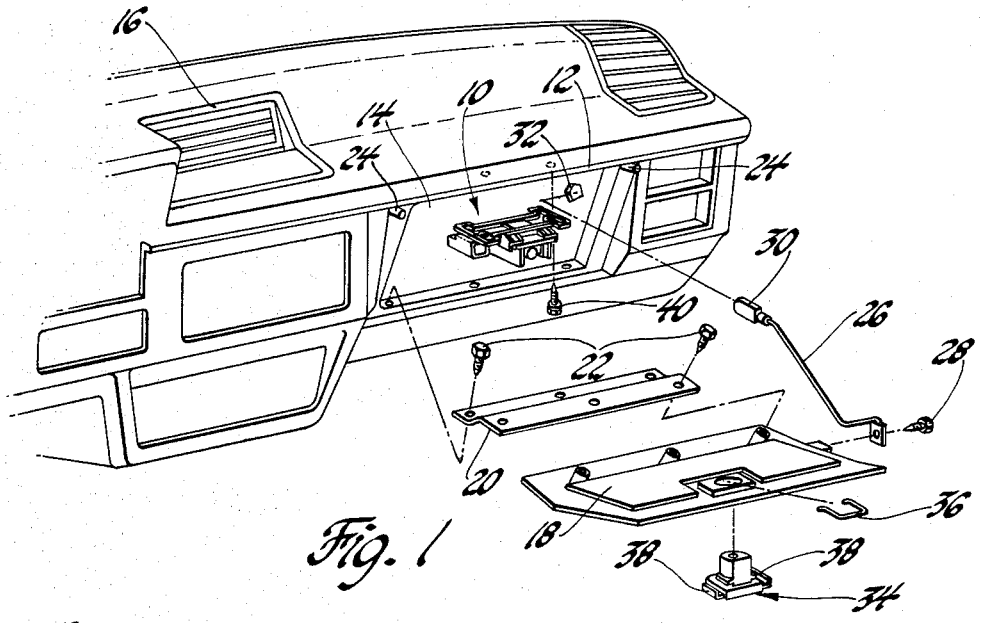
FIG. 1 is an exploded perspective view of a glove box door and adjustable latch striker according to this invention.

Referring first to FIG. 1, a striker assembly designated generally 10 is shown situated within the peripheral door frame or jamb 12 of a glove box 14 in the instrument panel or dashboard 16 of a vehicle or the like. A cover or door 18 sized to cover the opening of jamb 12 is joined to the bottom edge of door jamb 12 by a hinge 20 and bolts 22. Hinge 20 mounts door 18 to jamb 12 for rotative movement about the axis of hinge 20 between open and closed positions. In closed position, door 18 engages resilient bumpers 24. In the open position, a cable assembly 26 attached at one end by bolt 28 to a side of door 18 and having a stop 30 at the other end received through hole 32 maintains door 18 in position. A latch mechanism designated generally 34 is held to door 18 by clip 36. Latch mechanism 34 has a pair of resilient ears 38 which slide together and apart and which engage a striker element of striker assembly 10 to hold door 18 in a closed position. Striker assembly 10 is mounted by bolts, one of which is shown at 40, to the top edge of door jamb 12 as will be described below.

Figure 2:
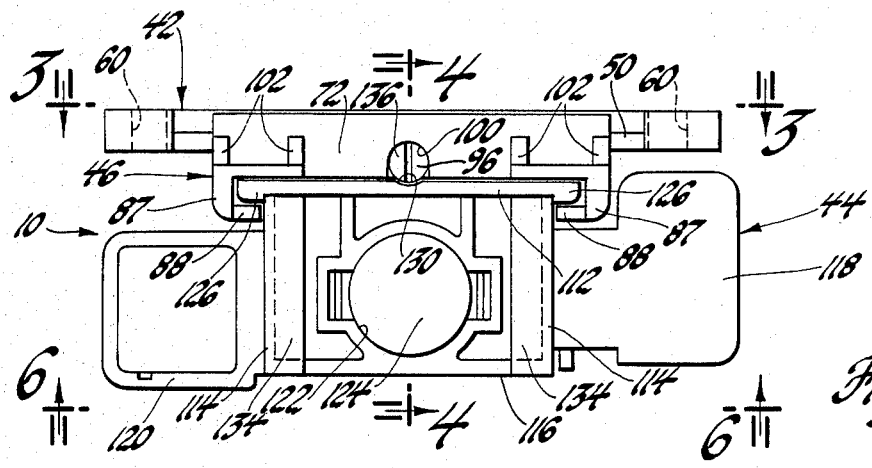
FIG. 2 is a front view of the striker.
Figure 3:
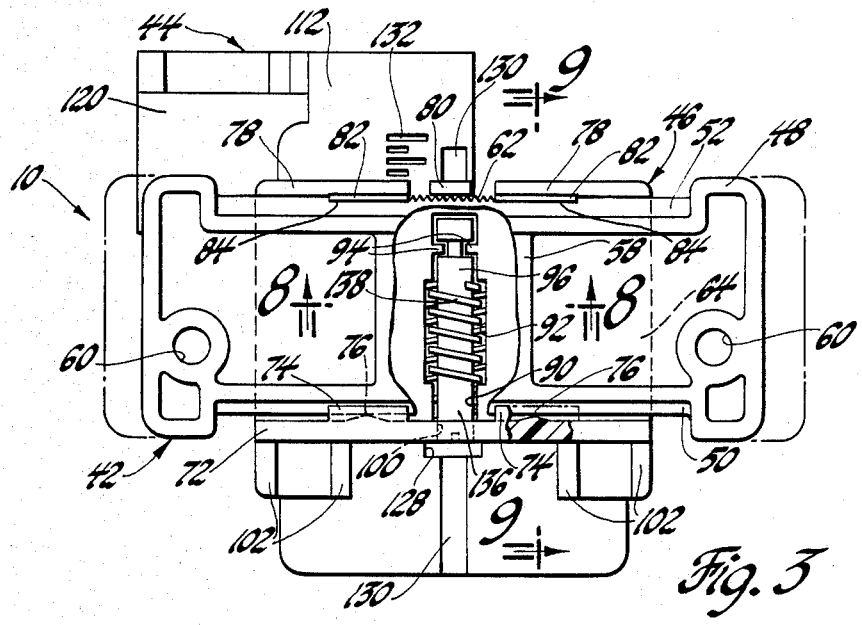
FIG. 3 is a plan view of the striker from the perspective of line 3—3 of FIG. 2.

Referring to FIGS. 2 and 3, striker assembly 10 is comprised of three basic members or sub-structures of molded plastic. The first sub-structure is a mounting member designated generally at 42, the second sub-structure is a housing or body member designated generally at 44 and the third sub-structure is an intermediate track member designated generally at 46 which joins mounting member 42 to body member 44. The interconnection and cooperation of these three sub-structures allows striker assembly 10 to be adjusted in two directions, both parallel to and perpendicular to the hinge axis of hinge 20, thus allowing complete adjustment and alignment after mounting member 42 has been affixed to the upper edge of door jamb 12.

Referring to FIG. 3, mounting member 42 has a generally rectangular shape with an integral upwardly extending peripheral strengthening rib 48 on the top face thereof which is inset along the front and rear to define parallel front and rear flanges 50 and 52. The bottom face of mounting member 42 is entirely flat except for a centrally located upwardly offset stepped recess 54, FIGS. 4 and 8, having a relatively deeper central portion 56 and covered by a centrally located boss 58 on the top face of mounting member 42. A flanged mounting hole 60 is located at each end of mounting member 42. Flange 52 is serrated by teeth 62.

Figure 7:
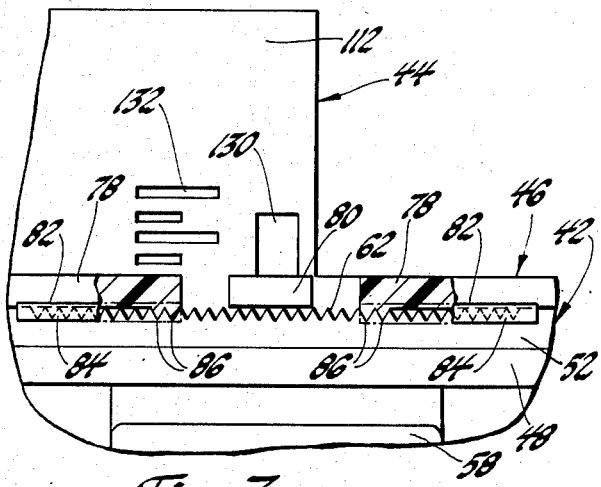
FIG. 7 is an enlarged view of a portion of FIG. 3.
Figure 8:
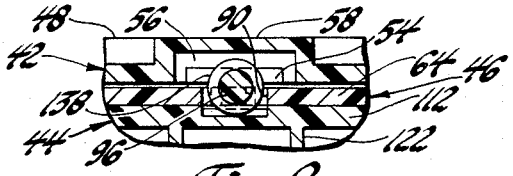
FIG. 8 is a partial section along the line 8—8 of FIG. 3.
Figure 10:
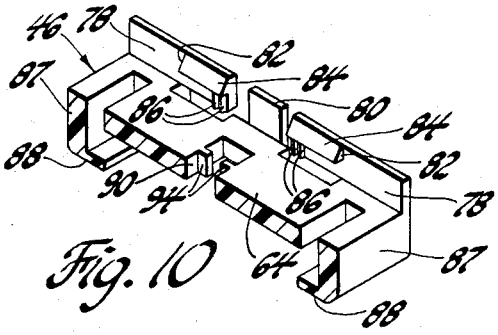
FIG. 10 is a perspective view of part of the striker.

Track member 46 has a generally rectangular base 64 with flat top and bottom faces, as best seen in FIG. 10. An upstanding flange 72 at the front edge of base 64 supports two spaced lateral tabs 74 which overlie front flange 50 of mounting member 42. Extending slightly inwardly from flange 72 beneath each tab 74 is a small bearing rib 76, best seen in FIG. 3, of generally triangular cross-section which bears against the edge of flange 50. Parallel to flange 72 are two coplanar resilient fingers 78 cantilevered from the rear edge of the top face of base 64 and separated by an intermediate, upstanding tab 80, as seen in FIG. 10. A shallow horizontal rib 82 on each finger 78 overlies rear flange 52, as best seen in FIG. 8. Each rib 82 has a downwardly sloped top surface 84. Beneath each rib 82 is a pair of serrations or teeth 86 which engage teeth 62 on the edge of flange 52 of mounting member 42, FIG. 7. A first track on track member 46 is thus defined by the top face of base 64, tabs 74 on flange 72, and ribs 82 on fingers 78.

Referring to FIG. 2, a wall 87 extends downwardly on each side of base 64. Each wall 87 includes a lateral tab 88 spaced from the bottom face of base 64, best seen in FIGS. 6 and 10 and defining a second track on track member 46.

Figure 4:
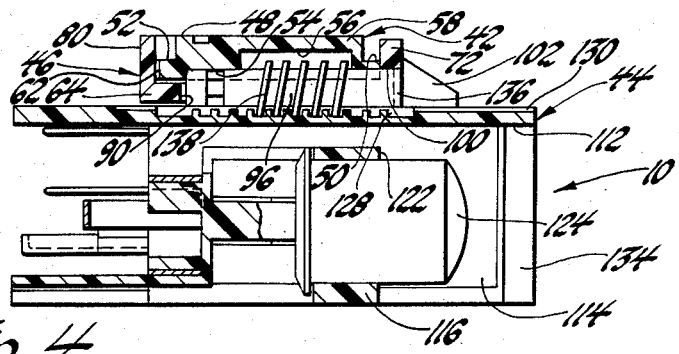
FIG. 4 is a sectional view of the striker from the perspective of line 4—4 of FIG. 2.
Figure 5:
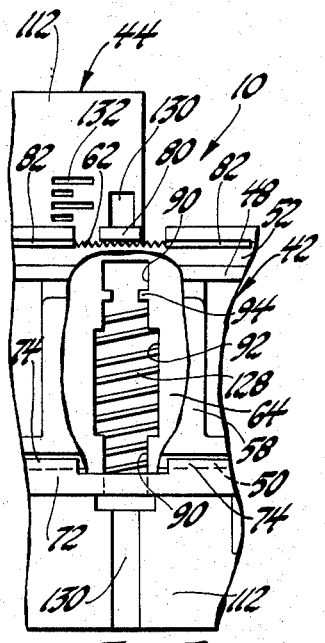
FIG. 5 is a view of a portion of FIG. 3 with an adjusting screw removed.

Base 64 also includes a central slot 90, which, as seen in FIG. 5, has an enlarged center portion 92 and a pair of opposed bearing ribs 94. Slot 90 receives an adjusting screw 96 further described below. The walls 87 also include a pair of clearance notches 98 best seen in FIG. 6, to facilitate the mounting of mounting member 42, described below. A screw access hole 100 passes through flange 72, FIGS. 3, 4 and 5, and ribbed extensions 102, FIGS. 4 and 9, extend between flange 72 and base 64 for added strength. Tabs 74 and 88 and ribs 82 all are arranged so as not to project over or beyond one another, so it is possible to match them all with aligned access slots through base 64 to obviate the need for sliding mold cores.

Figure 6:
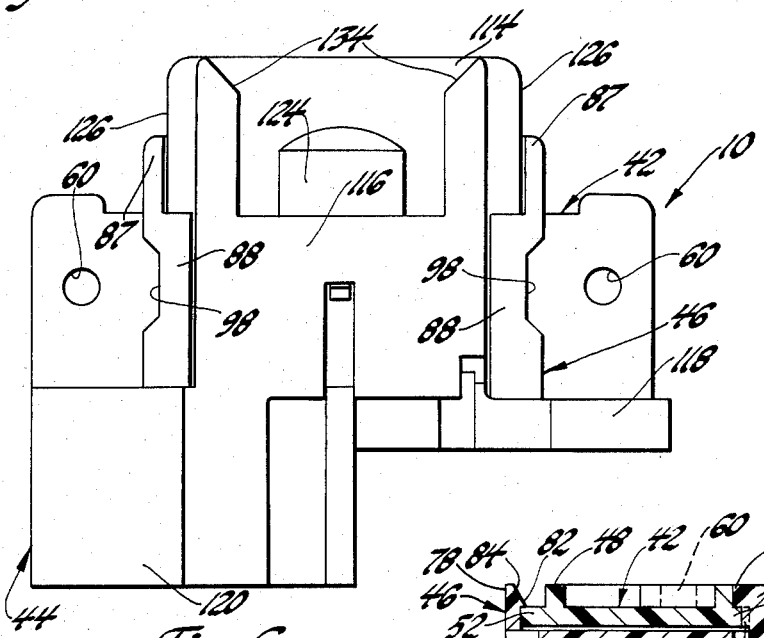
FIG. 6 is a bottom view of the striker from the perspective of line 6—6 of FIG. 2.

Referring to FIG. 2, body member 44 has a general box shape with a horizontally extending top wall 112, a pair of downwardly extending side walls 114 and horizontally extending bottom wall 116. An extension 118 on one side wall 114 may serve as a base for the attachment of an electrical connector body, and a box shaped extension 120 on the other side wall 114 may serve as a housing for a trunk release switch, not shown. A cylindrical housing 122 interposed between top wall 112 and bottom wall 116 may contain a conventional glove box light switch 124, best seen in FIG. 4. Top wall 112 extends slightly beyond side walls 114 and the edges 126 thereof are received between base 64 and tabs 88. Molded into the center of the top surface of wall 112 is a rectangular recess 128 ribbed to matingly engage screw 96, with a colinear, shallow semi-cylindrical groove 130 extending beyond each end thereof, best visible in FIG. 5. A scale 132 is also molded into the top surface of wall 112 parallel and adjacent to recess 128, which serves in the adjustment process, described below. As best seen in FIG. 6, the front edge of each side wall 114 includes a rearwardly and inwardly sloped jaw 134 which together comprise the camming surfaces of the striker element. The greatest separation of jaws 134 is larger than the separation of the fully extended resilient ears 38 on latch member 34 and the smallest separation is slightly greater that the separation of the ears 38 when fully compressed.

Figure 9:
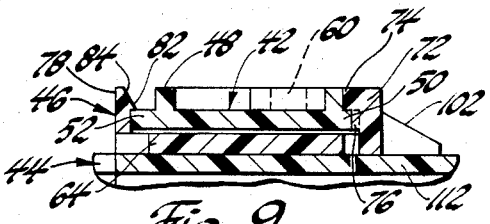
FIG. 9 is a partial section along the line 9—9 of FIG. 3.

The assembly of the three substructures may be understood by referring to FIGS. 2, 3, 8 and 9. Initially, track member 46 is assembled to body member 44 by sliding the side edges 126 under tabs 88 until track member 46 is located with slot 90 generally overlying recess 128. Next, the slotted head 136 of adjusting screw 96 is inserted within hole 100 and the screw dropped into recess 128, with the high lead thread 138 of the screw engaging the ribs of the recess 128. This engagement prevents relative sliding between members 46 and 44. Next, mounting member 42 is positioned generally centrally to track member 46 with rear flange 50 contained beneath tabs 74 and with the edge of flange 52 resting against the sloped top surfaces 84 of ribs 82. Downward pressure on member 42 forces the edge of flange 52 past sloped surfaces 84 and below ribs 82 as resilient fingers 78 bend outwardly to bring teeth 86 into mating engagement with teeth 62 to releasably secure members 42 and 44 with respect to each other. Adjusting screw 96 is captured between mounting member 42 and body member 44 and held flat by the engagement of stepped recess 54 with adjusting screw 96, best seen in FIG. 4. Deeper control portion 58 of recess 54 is, as seen in FIGS. 4 and 9, deeper and wider than thread 138 for a purpose described below.

To mount striker assembly 10, an initial rough fore and aft adjustment of track member 46 and mounting member 42 relative to body member 44 is done by turning adjusting screw 96 to move track member 46 to a predetermined position on scale 132. Next, mounting member 42 is mounted by bolts 40 extending through holes 60 into predrilled holes at the top edge of door jamb 12. Access to bolts 40 is available because of the clearance notches 98.

Next, door 18 is closed to engage resilient ears 38 of latch mechanism 34 with sloped jaws 134 on housing member 44. This forces members 44 and 46 to slide relative to member 42 as the teeth 86 on resilient fingers 78 ratchet relative to the teeth 62 of flange 52 as can be seen by the dash lines of FIG. 3. This movement is made possible by the clearance of thread 138, but screw 96 is still held flat, as seen in FIG. 4, to simultaneously maintain the fore and aft adjustment. The cross-car adjustment transverse of the vehicle parallel to the axis of hinge 20 is automatic, and requires no further tightening of screws or adjustment after the closing of the door. In addition, should housing member 44 become misaligned, it will automatically be realigned upon reclosing of door 18. If, after initial closing, it appears that door 18 still rattles or has not latched completely, then adjusting screw 96 may be turned fore and aft to adjust housing member 44 so that resilient ears 38 just engage the back of jaws 134 with door 18 compressing resilient bumpers 24. This fore and aft adjustment may be done at any time.

Additional features which may be incorporated with the striker assembly 10 are the provision of glove box illumination, by compression of button 124 upon door closing. Other buttons and electrical connections may be provided on extensions 118 and 120, as described, without affecting the adjustment.

Thus an adjustable latch striker has been provided in which various subassemblies are cooperatively connected to provide striker adjustment both fore and aft and laterally of the vehicle.

The embodiments of the invention in which an exclusive property or privilege is claimed are defined as follows:

1. A striker assembly for mounting on a door jamb and adapted for latching engagement by a latch mounted on a door movable about a hinge axis, said striker assembly comprising, a first member adapted for mounting on the door jamb in a fixed position, a second member having a striker element carried thereon for latching engagement by the latch upon closure of the door, track means mounting the second member on the first member for adjusting movement in a direction parallel to the hinge axis, ratchet means acting cooperatively between said first and second members to releasably maintain them in adjusted relative position, and cam means responsive to latching engagement of the latch with the striker element to release said ratchet means and adjustably move, under the force of said latching engagement only, the second member along the track means and thereby automatically align the striker element with the latch.

2. A striker assembly for mounting on a door jamb and adapted for latching engagement by a latch mounted on a door movable about a hinge axis for latching the door in a closed position, said striker assembly comprising, a first member adapted for mounting on the door jamb in a fixed position, a second member having a striker element carried thereon for latching engagement by the latch upon closure of the door, track means mounting the second member on the first member to allow adjusting movement of the second member in a direction parallel to the hinge axis to align the striker element with respect to the latch, ratchet means acting cooperatively between the first member and said track means to releasably maintain said first and second members in adjusted relative position, and cam means acting between the latch and striker element and operative upon movement of the door to closed position as the striker element engages the latch to automatically release the ratchet means and move the second member under the force of the latching engagement of the striker element and latch only along the track means in a direction parallel to the hinge axis for aligned latching engagement of the striker element by the latch.

3. A striker assembly for mounting on a door jamb and adapted for latching engagement by a latch mounted on a door movable about a hinge axis for latching the door in a closed position, said striker assembly comprising, a mounting member adapted for mounting on the door jamb in a fixed position, a body member having a striker element carried thereon for latching engagement by the latch upon closure of the door, a track member slidably mounting the body member to the mounting member to allow movement of the body member and track member in a direction parallel to the hinge axis, resilient finger means on the track member releasably engageable with cooperating detent means on the mounting member to releasably retain the track member and body member in adjusted position relative to the mounting member, the striker element and latch further including camming surfaces engageable upon door closing to ratchet adjust the resilient finger means relative to the detent means and shift the body member and track member relative to the mounting member to automatically correct any misalignment of the striker element and latch member.

* * * * *